US005262099A

United States Patent [19]

Adams et al.

[11] Patent Number: 5,262,099

[45] Date of Patent: Nov. 16, 1993

[54] PROCESS OF MAKING HIGH TENACITY POLYAMIDE MONOFILAMENTS

[75] Inventors: Earl B. Adams, Hixson; Robert K. Anderson, Signal Mountain; Rajive K. Diwan, Chattanooga, all of Tenn.

[73] Assignee: E. I. Du Pont de Nemours and Company, Wilmington, Del.

[21] Appl. No.: 861,993

[22] Filed: Apr. 1, 1992

[51] Int. Cl.[5] ..... B29C 35/10; D01D 5/12; D01F 6/60; D02J 1/22

[52] U.S. Cl. ..... 264/25; 264/178 F; 264/210.7; 264/210.8; 264/211.15; 264/211.17.290.5

[58] Field of Search ..... 264/25, 129, 130, 178 F, 264/210.7, 210.8, 211.15, 211.17, 290.5

[56] References Cited

U.S. PATENT DOCUMENTS

| | | | |
|---|---|---|---|
| 3,452,131 | 6/1969 | Geerdes et al. | 264/210.7 |
| 3,650,884 | 3/1972 | Hansen | 264/290.5 X |
| 3,963,678 | 6/1976 | Conrad et al. | 264/178 F X |
| 4,009,511 | 3/1977 | Gauntt | 264/25 |
| 4,056,652 | 11/1977 | Gauntt | 428/400 |
| 4,098,864 | 7/1978 | Morris et al | 264/289.3 |
| 4,396,570 | 8/1983 | Peckinpaugh et al. | 264/210.3 |
| 4,850,412 | 7/1989 | Gupta | 152/556 |
| 5,082,611 | 1/1992 | Adams et al. | 264/129 |

FOREIGN PATENT DOCUMENTS 461900 12/1991 European Pat. Off. .

OTHER PUBLICATIONS

Translation of Japan 59-157,314 (Published Sep. 6, 1984).

Translation of Japan 63-235,519 (Published Sep. 30, 1988).

*Primary Examiner*—Leo B. Tentoni

[57] ABSTRACT

A process of the type including the steps of spinning, water-quenching, and drawing a heavy denier, polyamide monofilament in at least first and second draw stages to a total draw ratio of at least about 5.5×. The quenched monofilament is advanced in the first draw stage through a steamer containing a high temperature steam atmosphere and is advanced in the second draw stage through a zone heated with a radiant heater. The improvement includes:

advancing the monofilament through a draw point localization zone in the first draw stage in advance of and remote from the steamer;

providing a generally uniform coating of liquid water to the monofilament in the draw point localization zone, the water being provided in an amount greater than about 5% by weight based on the dry weight of the monofilament; and heating the coating of water on the monofilament in the draw point localization zone generally uniformly to a temperature greater than about 90° C. for sufficient time to induce neck draw of the monofilament in the draw point localization zone.

16 Claims, 3 Drawing Sheets

PROCESS OF MAKING HIGH TENACITY POLYAMIDE MONOFILAMENTS

FIELD OF THE INVENTION

This invention relates to high tenacity, heavy denier polyamide monofilaments, and more particularly relates to heavy denier polyamide monofilaments having high tenacity and high tensile uniformity and a process for making such monofilaments which provides improved control over drawing in the first draw stage.

BACKGROUND OF THE INVENTION

U.S. Pat. Nos. 4,009,511, 4,056,652 and 5,082,611 disclose processes for making heavy denier, high tenacity polyamide monofilaments which are well suited for use in reinforced rubber goods such as tires. These processes include the steps of spinning, water-quenching, and drawing a heavy denier, polyamide monofilament in at least first and second draw stages. In the first draw stage, the quenched monofilament is advanced through a steamer containing a high temperature steam atmosphere and is advanced in the second draw stage through a zone heated with a radiant heater. The monofilament is drawn to a total draw ratio of at least about 5.5×. The monofilaments produced by these processes have a surface with an orientation less than the orientation of the core which, besides imparting improved physical properties to the monofilaments, provides good adhesion to rubber.

For achieving very high tenacities, i.e., greater than about 9 gpd, using processes of this type, it has been discovered that it is desirable for the extent of crystallization in the quenched monofilament to be low so that the monofilament can be drawn to higher draw ratios. This low crystallinity can be accomplished by very rapid cooling of the filament in cold quench water with an extended residence time so that the monofilament core temperature is cooled to below about 55° C. However, when the temperature of the core of the quenched monofilament is below about 55° C., problems can arise in the first draw stage. Rather than the desired single "neck" draw at the draw point, a series of separated necks may form that "run together" as the draw is completed. This type of draw results in low and variable tensile properties and poor spinning continuity and becomes more prevalent in higher denier monofilament as the thickness becomes greater since it is usually necessary with thicker filaments to get the surface and average temperature of the monofilament well below about 55° C. so that the core temperature is below about 55° C.

The process disclosed in U.S. Pat. No. 5,082,611 provides a method for controlling the location of the draw point and can provide a standard deviation of tenacity of less than about 0.25 in high tenacity monofilament. This process utilizes controlling the temperature of the quenched monofilament in advance of the steamer by adjusting the length of time in the quench bath or by regulating the quench bath temperature so that the draw point is maintained after the feed rolls and before the high temperature steam atmosphere. A preferred location for the draw point is in the steam expansion zone of the high pressure steamer. However, it is often difficult to provide the proper quench conditions which achieve both the low crystallinity needed for very high tenacities and the desired control over the location of the draw point to provide uniformity. Small perturbations in the process with time can result in movement of the draw point from outside to inside the steamer resulting in less than desired tensile strength and/or tensile strength uniformity.

Control over the draw point becomes especially difficult for higher denier monofilaments because the increased thickness requires more extreme quenching and lower surface and average monofilament temperatures to achieve low crystallinity. Thus, the draw point of the cooler monofilaments will tend to occur farther downstream in the process and it is sometimes difficult to avoid having part of the draw point within the high pressure steam zone. When this occurs, the steam penetrates too far into the monofilament surface causing deorientation and thus lower overall tensile strength of the yarn. In monofilaments where the minimum thickness of the monofilament when quenched is greater than about 0.8 mm, it has sometimes been found that quench conditions cannot be adjusted to provide both the desired low crystallinity and control of the draw point location at desirable process speeds.

SUMMARY OF THE INVENTION

In accordance with the present invention, an improved process is provided including the steps of spinning, water-quenching, and drawing a heavy denier, polyamide monofilament in at least first and second draw stages to a total draw ratio of at least about 5.5×. The quenched monofilament is advanced in the first draw stage through a steamer containing a high temperature steam atmosphere and is advanced in the second draw stage through a zone heated with a radiant heater. The improved process includes:

advancing the monofilament through a draw point localization zone in the first draw stage in advance of and remote from the steamer;

providing a generally uniform coating of liquid water to the monofilament in the draw point localization zone, the water being provided in an amount greater than about 5% by weight based on the dry weight of the monofilament; and heating the coating of water on the monofilament in the draw point localization zone generally uniformly to a temperature greater than about 90° C. for sufficient time to induce neck draw of the monofilament in the draw point localization zone.

Preferably, at least about 80% of the drawing in the first draw stage of the process occurs in the draw point localization zone.

The invention is particularly useful for thick monofilaments such as those where the minimum thickness of the quenched monofilament is greater than about 0.8 mm.

In accordance with a preferred form of the invention, the core temperature of the quenched filament before being advanced into the draw point localization zone is less than about 55° C., preferably less than about 50° C.

In accordance with a preferred form of the invention, the draw point localization zone is enclosed within a draw point localization chamber and the coating of water is provided by applying water heated to at least about 90° C. in the chamber.

In accordance with a preferred embodiment of the invention, the process further comprises heating the coating of water by contacting the coating of water with saturated steam in the chamber.

In accordance with another preferred embodiment of the invention, the process further comprises heating the coating of water by exposing the coating of water to microwave radiation in the chamber.

In accordance with another preferred embodiment of the invention, the monofilament is advanced vertically downwardly through the chamber.

In accordance with another preferred embodiment of the invention, the temperature of the high temperature steam atmosphere is greater than about 5° C. below the melting point of the hydrated polyamide of the monofilament.

In accordance with another preferred embodiment of the invention, the monofilament is advanced into the draw point localization zone at a speed greater than about 75 meters per minute.

In accordance with the invention, polyamide monofilaments are provided of greater than about 1000 denier having a tenacity greater than about 10 gpd, a formic acid relative viscosity of at least about 60, an along-end standard deviation of tenacity of less than 0.1 gpd, and a hot air shrinkage at 177° C. of less than about 15%.

Another polyamide monofilament in accordance with the invention of greater than about 1000 denier has a formic acid relative viscosity of at least about 60 and a cured-in-rubber tenacity greater than about 10 gpd.

Preferably, the monofilament product has a minimum thickness greater than about 0.35 mm.

BRIEF DESCRIPTION OF THE DRAWINGS

The present invention may be understood by reference to the drawings in which.

DETAILED DESCRIPTION

Polyamide as used in this application refers to any of the various generally linear, aliphatic polycarbonamide homopolymers and copolymers which are typically melt-spinnable and, when drawn, yield fibers having properties suitable for industrial applications. For example, poly(hexamethylene adipamide) (6,6 nylon) and poly(ε-caproamide) (6 nylon), poly(tetramethylene adipamide) (4,6 nylon) are typically-used polyamides for industrial fibers. The invention is also applicable to copolymers and mixtures of polyamides although such copolyamides and mixtures are generally not preferred since shrinkages are typically increased over homopolymers. Because of a balance of properties including dimensional stability which is imparted to the resulting fiber and reasonable melt-processing temperatures, homopolymer poly(hexamethylene adipamide) (6,6 nylon) is the preferred polyamide for the practice of the present invention.

The relative viscosity (RV) of the polyamide should be sufficiently high for good product properties. The RV, when measured in a capillary viscometer at 25° C. in a solution formed by dissolving 8.4% by weight polyamide polymer in a solvent of formic acid containing 10% by weight of water preferably is above about 60.

Figure 1:
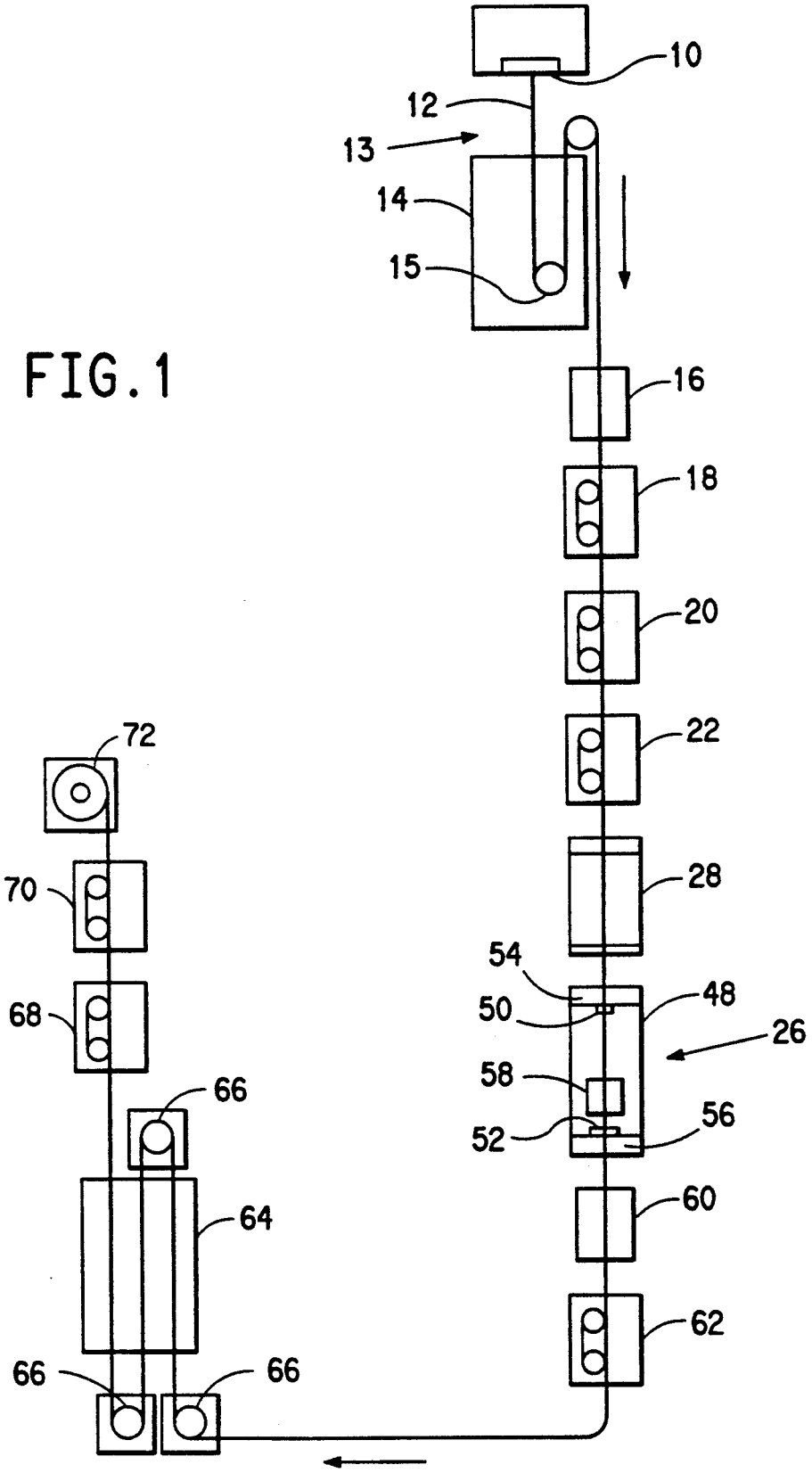
FIG. 1 is a schematic illustration of a process for producing a heavy denier, polyamide monofilament in accordance with the present invention.

Referring now to FIG. 1, illustrating a preferred process in accordance with the present invention, the polyamide is melt-spun through a spinneret 10 having, for example, a relatively large round, obround or rectangular spinneret orifice. The melt temperature, of course, is appropriate for the polyamide being spun. For 6—6 nylon, for example, melt temperatures from 270°-300° C. are suitable. The monofilament indicated by the numeral 12 in FIG. 1 is subjected to attenuation in an air gap 13 below the spinneret and quenched in a quench bath 14 containing water at a temperature less than about 50° C. The air gap 13 should be between about 10 and 40 inches in length before the filament enters the quench bath 14. Tension in the air gap and quench bath is minimized by adjusting the air gap distance in order to minimize the development of positive birefringence and orientation in the monofilament surface before the monofilament is orientation-stretched. However, the tension must be sufficient to provide stability to the threadline in the quench bath.

After leaving the quench bath 14, water in an amount of at least 10% based on the dry weight of the monofilament is provided on the monofilament before it contacts any surfaces such as feed rolls, guides or other surfaces. Preferably, the monofilament encounters an air jet designated by the numeral 16 which regulates residual quench water on the monofilament to between about 10% and about 25% by weight based on the dry weight of the monofilament.

The wet filament is then forwarded to puller rolls 18 which control the tension on the filament when spun and as it advances through the quench bath 14. The monofilament is then advanced through pre-tension rolls 20 and feed rolls 22. The pre-tension rolls are employed to increase tension on the monofilament to stabilize the monofilament on the feed rolls.

The monofilament is drawn in at least two draw stages with the total draw ratio being at least about 5.5×. In the first draw stage which occurs between the feed rolls 22 and first stage draw rolls 62, the monofilament is drawn at a draw ratio of at least 3.0×. Also within the first draw stage, the monofilament is subjected to treatment with a high temperature steam atmosphere in a steamer 26 as in known processes such as that disclosed in U.S. Pat. No. 5,082,611. However, unlike the process disclosed in U.S. Pat. No. 5,082,611, the process in accordance with the invention provides a draw point localization zone providing a treatment step which is separate and distinct from the treatment with the high temperature steam atmosphere and is enclosed within a chamber shown schematically as 28. The draw point localization zone thus is in advance of and remote from the steamer 26 containing the high temperature steam atmosphere and is enclosed within a chamber shown schematically as 28. Although the distance between the draw point localization zone and the high pressure steamer is not critical, typically a distance of approximately 10 to 40 inches depending on monofilament thickness and process speed is used to insure that the draw point does not approach the high pressure steamer under any conditions.

In the draw point localization zone, a generally uniform coating of liquid water is provided on the monofilament. It is believed that the advantage of having the filament wet at the first stage draw point is due to the imbibition of the water into the surface at the draw point. When the monofilament is dry, it is believed the lack of or insufficient water for imbibition leaves a more brittle, lower elongation fiber, also with a lower tenacity. At the draw point, the coating of water on the monofilament should be generally uniform and be in an amount greater than about 5% by weight based on the dry weight of the monofilament, so that steam does not directly contact the surface of the monofilament. Preferably, the amount of water provided is between about 5% and about 25%, most preferably between about 10% and about 15%.

The coating of water is heated in the draw point localization zone generally uniformly to a sufficient temperature and for a sufficient time to induce neck draw of said monofilament. It has been found that this temperature should be greater than about 90° C. Preferably, the water is heated to a temperature greater than about 95° C., most preferably 98° C.

Figure 2:
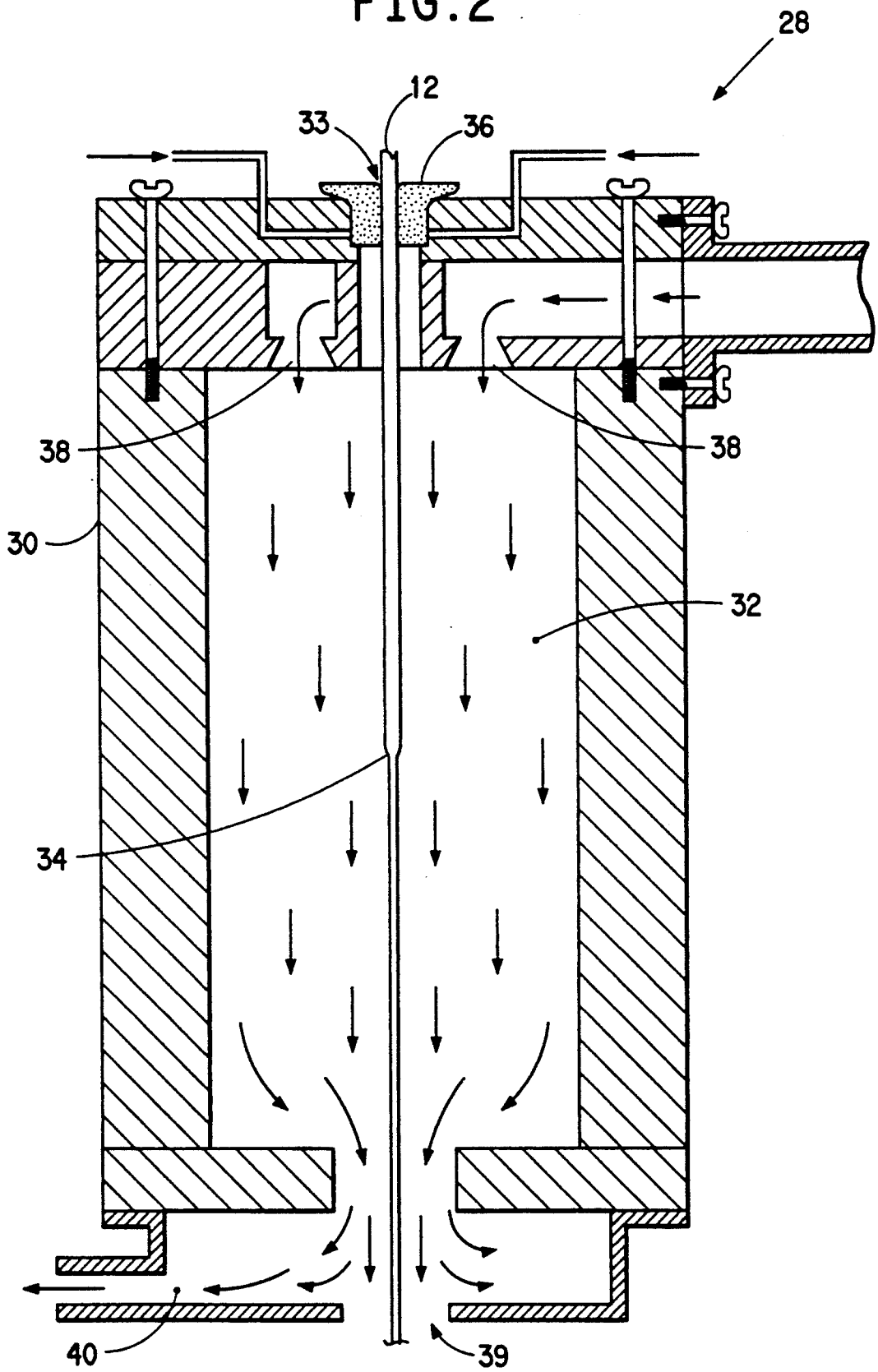
FIG. 2 is a partially schematic view of preferred apparatus providing the draw point localization zone which employs both heated water and steam as heat sources.

With reference now to FIG. 2 which is a partially schematic view of one preferred draw point localizer 28 which employs both heated water application and steam as heat source for inducing neck draw. In this preferred apparatus, the combination of heated water and steam is used instead of steam with cold water to avoid the time required to heat the water and thereby shorten the residence time for the monofilament to be heated to a temperature at which neck draw occurs.

The draw point localizer 28 includes a body 30 which provides an enclosed chamber 32 of sufficient length to enclose the draw point (designated by the numeral 34) and provides adequate heating for drawing using steam at or near atmospheric pressure. The chamber 32 is preferably is sufficiently long to contain the extended neck draw of heavy monofilaments. Typically, a chamber of 9 to 24 inches in length may be used.

The draw point localizer 28 provides means to uniformly apply the heated water to the monofilament as it enters the chamber through entrance 33. Felt wicks 36 which encircle the monofilament 12 where it enters the draw point localizer 28 are suitably employed for this purpose. The wicks 36 supply heated water from a source (not shown) and heated via a coiled heat exchanger (also not shown) in the body of the draw point localizer 28.

The draw point localizer 28 shown in FIG. 2 also provides a means for supplying steam from a source (not shown) to the chamber 32. This is suitably accomplished using a steam supply manifold 38 which provides steam at a low flow rate into the chamber 32 close to the entrance 33. Adjacent to a monofilament exit 39, a steam exhaust 40 is provided which is connected to a source of vacuum (not shown) to withdraw the steam from the chamber and prevent the steam being vented into the plant environment. It is preferable for the steam in the chamber 32 to be saturated steam at atmospheric pressure since it has been found that higher temperatures are not necessary to keep the coating of water hot enough to induce draw in the monofilament and control over temperature is facilitated. Provided the exhaust 40 and/or monofilament exit 39 are suitable, low pressure saturated steam, preferably at about 5 to 15 psi, can be supplied to the manifold 38 to provide the atmospheric pressure steam atmosphere in the chamber 32.

Figure 3:
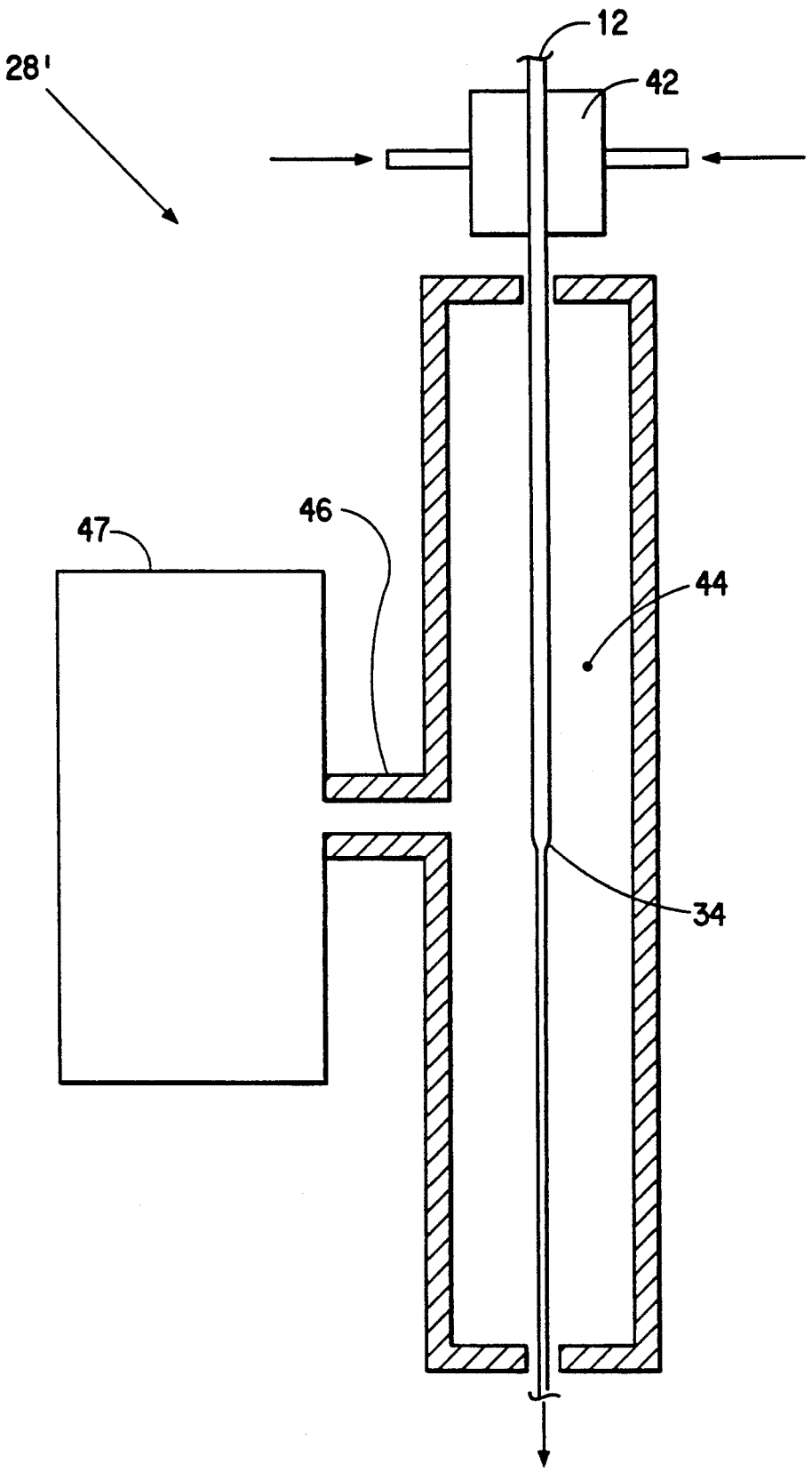
FIG. 3 is another preferred apparatus providing the draw point localization zone which employs microwave radiation as the heat source.

FIG. 3 illustrates another preferred embodiment of draw point localization apparatus 28' which employs microwave radiation as the heat source. This apparatus operates similar to draw point localizer 28 in that water is coated on the monofilament using means such as felt wicks at water applicator 42 although there is no advantage in heating the water. The water coated monofilament enters a tuned microwave cavity 44 which is supplied through a wave guide 46 with microwave radiation from a microwave source 47. The microwave source can be, for example, a 1800 watt (Max.) 2450 MHz microwave generator. The water on the monofilament is heated by the microwave radiation to heat the monofilament to induce draw.

While the depicted embodiments using heated water/low pressure steam and microwave radiation are preferred, other techniques can be used. For example, a hot water bath could be used. While special techniques may have to be used to provide the uniform water coating on the monofilament at the draw point, other sources of heat may be usable including, for example, radiant heaters or flame heat sources.

The draw point localizer 28 provides a way to stabilize the draw point as a single neck draw away from the high pressure steam atmosphere. The monofilament thereby can be more thoroughly quenched to achieve a monofilament core temperature less than about 55° C. to provide low crystallinity and yield higher tenacity products without the possible loss of control over the draw point location which can adversely affect uniformity. Thus, the invention is especially useful with higher denier monofilament products in which the minimum thickness of the quenched monofilament is greater than about 0.8 mm. Viewing the monofilaments in cross-section, "minimum thickness" as used herein refers to the diameter of the smallest inscribing circle determined by the monofilament cross-sectional surface. It has been found that the process is advantageous for all deniers, particularly when high draw ratios are used to obtain high tenacity, to minimize the effect of process variations such as changes in relative viscosity or the amount of chain branching in the polymer supply which affect the draw point location.

Referring again to FIG. 1, after leaving the draw point localizer 28, the monofilament 12 enters the high temperature steamer 26. The steam atmosphere of the steamer substantially deorients and hydrates the surface of the monofilament to prevent or minimize the development of molecular orientation or birefringence in the surface as the filament is stretched. The conditions for steaming are established to conform to the properties of a particular polyamide. The steam atmosphere in the steamer 26 for 6—6 nylon is typically between about 80 and 170 psig and the steam may be selected from a range of from 40% wet to 120° C. of superheat.

The steamer is suitably provided by an elongated casing which provides a pressurized steam chamber 48 having an entrance seal 50 and an exit seal 52 which minimize steam pressure loss while admitting the monofilament 12 into the chamber 48 and providing an exit for the monofilament at the opposite end. Preferably, the steamer 26 also has separate chambers at each end providing entrance and exit steam expansion zones 54 and 56, respectively, which are connected to a vacuum source (not shown). Seals with openings somewhat larger than the seals 50 and 52 are provided for these chambers for the monofilament to enter and exit the steamer. The primary purpose for the expansion zones is to prevent steam which leaks through the seals 50 and 52 from being vented into the plant environment. In the process disclosed in U.S. Pat. No. 5,082,611, the expanding steam in the entrance to the steamer was utilized as a draw assist. Since this function is no longer needed with the present invention, the size of the expansion zone can be drastically reduced thus reducing the overall size of the steamer 26.

To reduce the likelihood that the monofilament will become damaged at least intermittently as it exits from the steamer by contact with the exit seal 52, the monofilament surface is cooled prior to passing through the steamer exit seal 52 to less than 100° C. Preferably, this is accomplished as indicated in FIG. 1 by passing the monofilament through a water bath 58 provided within the chamber 48 of the steamer 26. It is advantageous for the bath to have a temperature of less than about 80° C. In the preferred embodiment, the water bath 58 is located in the chamber 48 adjacent the exit seal 52 so that the monofilament is exposed only briefly to high temperature steam in the chamber 48 after the bath and is not substantially reheated. Thus, the water bath 58 effectively serves as the end of the high temperature steam heating zone.

After exiting the steamer 26, an air stripper 60 removes most, e.g., leaves less than about 2%, of the surface water on the monofilament 12.

After exiting from the steamer 26 and passing through stripper 60, the monofilament 12 is then contacted by first stage draw rolls 62. The amount of draw in the first draw stage is determined by the speed of first stage draw rolls in relation to the feed rolls 22. The first stage draw rolls 62 are preferably heated to begin heating the monofilament for the second stage draw. Heated draw rolls enable the use of a shorter path length through the second stage heater and better control the second stage draw. For 6-6 nylon, the rolls are heated to a temperature of 110°-160° C., preferably about 140° C.

From the first stage draw rolls 62, the monofilament 12 advances into a radiant heater 64 employed in the second stage draw. Radiant heating in the second stage draw involves the use of a heater 64 at temperatures and residence times matched to the polymer of the monofilament. For 6-6 nylon, a temperature of 700° C. to 1300° C. with an exposure time such that the filament surface temperature remains at least 10° C. below the melting point of the polymer is preferably employed. As disclosed in U.S. Pat. No. 5,082,617, the monofilament is preferably conveyed over change-of-direction rolls 66 in the second draw stage to provide several passes through the radiant heater 64 and with controlled amount of draw in each pass to provide a controlled draw profile. For 6-6 nylon, for example, an optimum second stage draw profile is one that does not exceed a total draw ratio of about 4.0 until the filament core temperature is greater than that at which a molecular transformation takes place such as the triclinic to hexagonal crystal transformation that is believed to take place at 140°-160° C. If draw in excess of 4.0× occurs below this temperature, molecular chains will rupture because the intramolecular bonds of the triclinic crystal are greater than the carbon-carbon chain bonds which reduces molecular weight and, in turn, tenacity and fiber fatigue resistance.

Referring again to FIG. 1, the monofilament exits from the heater 64 and contacts the second stage draw rolls 68. The difference in speed between the second stage draw rolls and the first stage draw rolls determines the draw ratio in the second draw stage. The monofilament 12 passes around tension let-down rolls 70 before windup of the monofilament on a package 72.

In a preferred form of the present invention, monofilaments are spun at a polymer throughput rate of greater than about 13 kg (30 pounds) per hour per monofilament, most preferably 20 kg (45 pounds) per hour per monofilament.

By employing the process of the invention, a monofilament of the invention of greater than about 1000 denier can be produced which has a tenacity greater than about 10 gpd, a formic acid relative viscosity of at least about 60, an along-end standard deviation of tenacity of less than 0.1 gpd, and a hot air shrinkage at 177° C. of less than about 15%. Another form of the monofilament of the invention of greater than about 1000 denier has a formic acid relative viscosity of at least about 60 and a cured-in-rubber tenacity greater than about 10 gpd.

Preferably, the monofilament has a minimum thickness greater than about 0.35 mm. The minimum thickness greater than about 0.35 mm for a drawn filament corresponds generally to a quenched filament thickness of 0.8 mm. Known processes have not provided monofilaments of this thickness with both the high tenacity and the standard deviation in tenacity of less than 0.1. Preferably, the monofilament has an along-end standard deviation of tenacity of less than about 0.05. When the process of the invention is applied to filaments thinner than 0.35 mm, it has been found that higher draw ratios can be used resulting in products with very high in-use tenacity.

Monofilaments in accordance with the invention may have a variety of cross-sectional shapes. Preferably, the monofilaments have an oblong cross-section, most preferably with a width-to-thickness ratio greater than about 2.0, i.e., the width of the circumscribing rectangle divided by the thickness, is greater than about 2.0.

Preferably, in a monofilament in accordance with the invention, the cross-section is obround, i.e., having a generally rectangular cross-section with rounded corners or semicircular ends and thus is produced by spinning through an obround or rectangular spinneret orifice. Depending on the viscosity of polymer as extruded, the resulting monofilament has a cross-section which may vary somewhat from the cross-section of the spinneret and may assume some oval character and the "flat" areas may be somewhat convex. As used herein for cross-sections of monofilaments, obround is intended to refer to obround cross-sections or those which approximate obround cross-sections. Other preferred embodiments include monofilaments with an oval cross-section.

The denier of the monofilaments in accordance with the invention can be as high as 12000 or more. Monofilaments having a denier of greater than about 2000 are preferred.

Monofilaments produced in the process have a deoriented surface layer which for polyamides is about 3-15 microns thick with a parallel refractive index, $n_{\parallel}$, of less than 1.567 and a core parallel refractive index, $n_{\parallel}$, of greater than 1.57. Due to the deoriented surface layer which provides good adhesion to rubber, the monofilaments are ideally suited for in-rubber applications.

The invention is further illustrated in the examples which follow in which the results reported are determined by the following test methods.

TEST METHODS

Conditioning: Large denier monofilaments of this invention require up to 10 days for the moisture content to fully equilibrate with atmospheric moisture. In the testing of filaments described in the following, various periods of time less than that required to achieve full moisture regain were sometimes used. For example, a 2000 denier monofilament that is about 0.012" (0.3 mm) thick takes about three days to equilibrate, but a 6000 denier filament that is about 0.018" (0.46 mm) thick takes about five days. The actual length of time required depends on the thickness of the monofilament. The monofilament properties reported in the Examples were measured after 24 hours of conditioning after spinning. For properties set forth in the claims, measurement is intended at full moisture equilibration (when two measurements of denier 24 hours apart are the same).

Relative viscosity of polyamides refers to the ratio of solution and solvent viscosities measured in capillary viscometer at 25° C. The solvent is formic acid containing 10% by weight of water. The solution is 8.4% by weight polyamide polymer dissolved in the solvent.

Width and Thickness are measured with a Starrett Model 722 digital caliper or equivalent instrument. For width measurements it is convenient to fold the monofilament into a "V" and measure both sides of the "V" at the same time, being sure to keep the vertex of the "V" just outside the measured zone. This technique assures that the monofilament does not tilt between the faces of the measuring instrument giving a low reading.

Minimum Thickness is measured from a photomicrograph of a monofilament cross-section taken perpendicular to the filament axis. Using a compass, the smallest circle that can be inscribed within the cross section is determined and the diameter of this circle is the minimum thickness. Minimum thickness for simple cross-sections such as round, obround, oval, and rectangular can be determined using the caliper method described above for determining width and thickness.

Denier: The monofilament is conditioned at 55±2% relative humidity, and 75°±2° F. on the package for a specified period, usually 24 hours when the monofilament has aged more than ten days since being made. A 0.9 meter sample of monofilament is weighed. Denier is calculated as the weight of a 9000 meter sample in grams.

Tensile Properties: Before tensile testing of as-spun monofilaments, the monofilament is conditioned on the package for a minimum specified period at 55±2% relative humidity and 75°±2° F. This period is usually 24 hours when the filament has aged more than ten days since spinning. A recording Instron unit is used to characterize the stress/stain behavior of the conditioned monofilament. Samples are gripped in air-activated Type 4-D Instron clamps maintained at least 40 psi pressure. Samples are elongated to break while continuously recording monofilament stress as a function of strain. Initial gauge length is 10 inches (25.4 cm), and cross head speed is maintained at a constant 6 inches (15.3 cm)/minute.

Break strength is the maximum load achieved prior to rupture of the sample and is expressed in pounds of kilograms.

Tenacity is calculated from the break strength divided by the denier (after correcting for any adhesive on the filament) and is expressed as grams per denier (g/d).

Elongation is the strain in the sample when it ruptures.

Modulus is the slope of the tangent line to the initial straight line portion of the stress strain curve, multiplied by 100 and divided by the adhesive-free denier. The modulus is generally recorded at less than 2% strain.

The knot tensiles are measured in the same manner as straight tensiles except that a simple overhand knot is tied in the monofilament at about the midpoint of the sample to be tested. The simple overhand knot is made by crossing a length of monofilament on itself at about the midpoint of its length and pulling one end through the loop so formed. Since the monofilament tends to assume some of the curvature of the wind-up package, the knot is tied with and against this curvature on separate samples and the two values averaged.

Toughness is the product of tenacity in gpd times the square root of the break elongation in percent.

Cured-in-rubber tenacity is measured by wrapping adhesive (RFL) treated cord around a 2⅞ inch (7.3 cm) by 10⅞ inch (27.6 cm) clean, flat steel plate with approximately 0.025 inch spacing between adjacent wraps of cord. When the desired number of wraps (generally 5) have been made, the two ends of the cord are tied together at the back of the plate using a double square knot to firmly secure the sample to the plate. A 2⅞ inch (7.3 cm) by 10⅞ (27.6 cm) inch piece of rubber of appropriate composition (in this case a typical passenger tire carcass stock formulation), 0.030" (0.76 mm) thick, is placed on top of the cords wrapped around the plate. The sample is then cured in a hydraulic press for 20 minutes at 177°±2° C. under 3.3 (3000 kgm) tons pressure. At the end of the curing cycle the sample is removed from the press and the exposed cords on the back side of the plate are immediately cut. After cooling to room temperature, the cords are pulled from the rubber and then allowed to condition at 24° C./55% RH for at least 48 hrs. Cured-in-rubber breaking tenacity is then determined using a 6 inch (15.2 cm) gauge length and a strain rate of 120%/min.

Dry Heat Shrinkage is measured on a Testrite shrinkage instrument manufactured by Testrite Ltd. Halifax, England. A ~24" (~61 cm) length of monofilament is inserted into the Testrite apparatus and the shrinkage recorded after 2 minutes at 177° C. under a 0.05 g/d load. Initial and final lengths are determined under the 0.05 g/d load. Final length is measured while the monofilament is at 177° C. To insure accuracy, monofilament temperature is calibrated by attaching a thermocouple to the monofilament.

EXAMPLE 1

This example describes the preparation by the preferred process in accordance with the invention of an approximately 6000 denier polyhexamethylene adipamide monofilament having an obround cross-section with a width-to-thickness ratio of about 3.

High quality polyhexamethylene adipamide polymer is made in a continuous polymerizer having a relative viscosity of 70 and is extruded into a monofilament at a rate of 45 pounds per hour (20.5 kg/hr) through an obround spinneret orifice (rectangular having rounded corners 2.79×9.65 mm), is passed vertically downward through an air gap of 23 inches (58.4 cm), and is quenched in water at 27° C. for a distance of 188 inches (477 cm). After water quenching, the amount of residual quench water on the filament is regulated by adjustment of the air flow in an air jet so that the quantity of water on the surface of the filament is between 10 and 25% by weight of water on the dry weight of the monofilament. The wet monofilament is then forwarded in sequence to a puller roll at 97.0 ypm (88.7 mpm), pretension rolls at 97.7 ypm (89.4 mpm), and feed rolls at 98.5 ypm (90 mpm).

After the feed rolls, the monofilament enters the draw point localizer of the type depicted in FIG. 2 with a water flow rate of 2.0 gallons per hour and a temperature of 99.8° C. being supplied to the felt wick hot water applicator. The draw point locator apparatus is 18 inches (45.7 cm) long and is supplied with atmospheric saturated steam at 100° C. to keep the water layer at ~100° C. A first stage draw ratio of 4.08× is used and the draw point is within or at the exit of the draw locator apparatus. Approximately 36 inches (91.4 cm) of space exists between the draw locator apparatus and the high pressure steamer.

The monofilament is next forwarded in a 49 cm long steamer of the type depicted in FIG. 1 and is treated with saturated steam at 140 psi (180° C.). While still in the steamer but near the exit of the high pressure steam chamber, the monofilament is run through a bath about 3 cm long containing water at a temperature of 60° C. and flowing at a rate of about six gallons per hour. The surface of the monofilament is cooled in the bath before leaving the steamer in order to avoid damage of the filament by the exit seal of the steamer. The monofilament is then forwarded to an air stripper which removes most of the surface water from the filament to a level of less than 2% water on weight of the dry filament. The monofilament is then forwarded to the first stage draw rolls which are heated to 140° C. and running at 401.9 ypm (367.3 mpm).

The filament is then forwarded in two passes through a radiant heater of about 50 inches (127 cm) in length at a mean temperature of about 910° C. Controlled speed of the roll prior to the first pass through the heater was 418.4 ypm (382.4 mpm), after the first pass was 490.5 ypm (448.3 mpm), and after the second pass was 527.7 ypm (482.3 mpm). The monofilament is then forwarded to the second stage draw rolls running at about 576 ypm (526.5 mpm), tension letdown rolls at about 563.3 ypm (516.7 mpm), and to a windup package at 565.3 ypm (516.7 mpm). The windup tension is about 900 grams and is adjusted for good package formation.

Physical properties of the resulting monofilament are shown in Table 1.

EXAMPLE 2

The process of the invention was used to make an approximately 6000 denier polyhexamethylene adipamide monofilament having an obround cross-section a width-to-thickness ratio of about 4.8.

Process conditions were the same as Example 1 except for the spinneret orifice of 2.24×12.7 mm, the puller roller speed of 96.6 ypm (88.3 mpm), an additional quench after the puller roller of 188 inches (477 cm) was done with water at the same temperature (calculated monofilament core temperature of 42° C.), the pretension roll speed of 97.3 ypm (89.0 mpm), the feed roll speed of 98.1 ypm (98.7 mpm), the draw point localizer was supplied with 99.8° C. water at a rate of 1.5 gallons per hour.

Physical properties of the resulting monofilament are shown in Table 1.

COMPARATIVE 1

A 6000 denier polyhexamethylene adipamide monofilament was a width-to-thickness ratio of about 3 was prepared as in Example 1, except without the draw point localizer. Water at 1.0 gallon per hour and at 35° C. was added to the monofilament prior to the high pressure steaming step. Physical properties are shown in Table 1. Compared to the preferred proces in Example 1, yarn tenacity is significantly lower, product is less uniform, and elongation at break and toughness are lower. More breaks occurred in this process than in Example 1.

COMPARATIVE 2

A 6000 denier polyhexamethylene adipamide monofilament was prepared as in Comparative 1 again without the first stage draw point localizer apparatus but now with a lower first stage draw ratio (3.73×) and lower total draw ratio (5.73×) to obtain satisfactory spinning continuity which was poor with Comparative 1. Process conditions were the same as Comparative 1 except for puller roll speed of 99.1 ypm (90.6 mpm), pretension roll speed of 99.8 ypm (90.8 mpm), feed roll speed of 100.5 ypm (91.9 mpm), first stage roll speed of 374.9 ypm, (342.7 mpm) roll speed before first pass of radiant heater of 390.9 ypm (357.3 mpm), roll speed after first pass of radiant heater of 475.5 ypm (434.6 mpm) and roll speed after second pass of radiant heater of 520.4 ypm (475.6 mpm).

Physical properties of Comparative 2 are given in Table 1. While spinning continuity and product uniformity is good in this Comparative 2 as compared with Comparative 1, tenacity is not as high since a lower draw ratio was used.

EXAMPLE 3

The process of the invention was used to make an approximately 2000 denier polyhexamethylene adipamide monofilament having an obround cross-section and a width-to-thickness ratio of about 3.0.

Process conditions were the same as Example 1 except for the polymer throughput of 30.8 pounds per hour (14 kg/hr), spinneret orifice of 2.79×9.65 mm, the air gap of 19 inches (48 cm), quench distance of 104 inches (227 cm) (calculated monofilament core temperature of 41° C.), the puller roller speed of 94.6 ypm (86.5 mpm), the pretension roll speed of 95.15 ypm (87.0 mpm), the feed roll speed of 96.1 ypm (87.8 mpm), the draw point localizer was supplied with 99.8° C. water at a rate of 1.5 gallons per hour.

Additional differences were a first stage draw ratio of 4.18× and the draw point being localized by only the application of 98° C. water by use of a hot water applicator. (No steam was used to maintain the water temperature on the monofilament.) In the second draw stage one pass was used with the roll speed before the radiant heater being 413 ypm (377.6 mpm) and after the radiant heater being 563 ypm (513.9 mpm). The second stage draw roll speed was 576 ypm (526.5 mpm), tension letdown rolls at 565.2 ypm (516.7 mpm), and the to a windup package at 565.3 (516.7 mpm) with a windup tension of 620 grams.

Physical properties of the resulting monofilament are shown in Table 1. This product has a cured-in-rubber tenacity greater than 10 gpd which is the highest known cured-in-rubber tenacity for any polyhexamethylene adipamide monofilament.

EXAMPLE 4 and 5—COMPARATIVES 3 and 4

Examples 4 and 5 illustrate the use of a microwave draw point localizer of the type illustrate in FIG. 3. Process conditions for 6000 and 3000 denier monofilaments with width-to-thickness ratios of about 3 were similar to Example 1 except for a 2450 megahertz, 18 inch long microwave heater was installed in place of the hot water/steam draw point localizer and the other process differences noted in Table 2. Water at ambient temperature was applied to the monofilament in the amount of about 1 gallon per hour. As indicated in Tables 2 and 3, the microwave unit was used to heat the water in Examples 4 and 5 and was turned off for Comparatives 3 and 4. Physical properties are shown in Table 3. As can be seen from Table 3, the use of the microwave draw point localizer in Examples 4 and 5 yielded superior tensile properties when compared with Comparatives 3 and 4, respectively.

TABLE 1

| | EXAMPLE 1 Draw Pt. Localizer | EXAMPLE 2 Draw Pt. Localizer | COMPARATIVE 1 No Draw Pt. Localizer | COMPARATIVE 2 No Draw Pt. Localizer | EXAMPLE 3 Draw Pt. Localizer |
|---|---|---|---|---|---|
| 1st D.R. | 4.08X | 4.10X | 4.10X | 3.73X | 4.18X |
| Total D.R. | 5.85X | 5.92X | 5.92X | 5.73X | 6.00X |
| Speed, ypm (mpm) | 576 (527) | 576 (527) | 576 (527) | 576 (527) | 576 (527) |
| Denier (nominal) | 6000 | 6000 | 6000 | 6000 | 2000 |
| Straight Tenacity, gpd | 9.49 | 10.5 | 9.10 | 8.79 | 10.9 |
| Straight Tenacity - Std. Deviation (gpd) | 0.05 | .03 | 0.22 | 0.05 | .05 |
| Number of Observations | 80 | 20 | 80 | 72 | 10 |
| Elongation at Break (%) | 19.7 | 16.09 | 15.5 | 17.23 | 10.8 |
| Toughness, Tx $(E)^{\frac{1}{2}}$ [gpd x $\%^{\frac{1}{2}}$] | 42.1 | 35.0 | 35.8 | 36.4 | 34.7 |

| | EXAMPLE 1 Draw Pt. Localizer | EXAMPLE 2 Draw Pt. Localizer | COMPARATIVE 1 No Draw Pt. Localizer | COMPARATIVE 2 No Draw Pt. Localizer | EXAMPLE 3 Draw Pt. Localized by Hot Water Application Only |
|---|---|---|---|---|---|
| Knot Tenacity, gpd | 5.5 | — | 5.3 | 5.2 | — |
| Knot Tenacity - Std. Deviation (gpd) | 0.68 | — | 0.30 | 0.36 | — |
| Testrite Shrinkage (%) | — | 8.4 | — | — | 8.3 |
| Operability | Excellent | Good | Poor | Good | Good |
| Draw Point Location | Draw Point Localizer | Draw Point Localizer | At High Pressure Steamer Inlet Seal | In High Pressure Steamer | 10 inches (25.4 cm) Below Hot Water Applicator |
| Thickness (mm) | 0.46 | 0.36 | 0.46 | 0.46 | 0.27 |
| Width (mm) | 1.38 | 1.74 | 1.38 | 1.38 | 0.80 |
| Width-to-Thickness Ratio | 3 | 4.8 | 3 | 3 | 3 |
| Cured-in-Rubber Tenacity (gpd) | 9.2 | — | — | — | 10.1 |

TABLE 2

| | Comparative 3 | Example 4 | Comparative 4 | Example 5 |
|---|---|---|---|---|
| Nominal Denier | 6000 | 6000 | 3000 | 3000 |
| Polymer RV | 70 | 70 | 70 | 70 |
| Flow Rate, kg/hr | 19.2 | --> | 18.7 | --> |
| Spinneret Orifice, mm | 2.79 × 9.65 | --> | --> | --> |
| Air Gap, cm | 66 | --> | 68 | --> |
| Quench Water Temp | 27° C. | --> | 18° C. | --> |
| Quench Distance, m | 3.75 | --> | 3.67 | --> |
| Speeds (mpm) | | | | |
| Puller Roll | 82.7 | --> | 167.2 | --> |
| Pretension | 83.1 | --> | 168.4 | --> |
| Feed | 84.0 | --> | 170.0 | --> |
| 1st Stage | 327.9 | --> | 655.0 | --> |
| 2nd Stage | 488.3 | --> | 960.0 | --> |
| Relaxation | 479.1 | --> | 942.1 | --> |
| Steamer | | | | |
| Press, Kpa | 965 | --> | --> | --> |
| Temp, °C. | 180 | --> | --> | --> |
| 1st Stage Roll Temp °C. | 146 | --> | --> | --> |
| 2nd Stage IR Heater °C. | 870 | --> | 895 | --> |
| Microwave | | | | |
| Watts | Off | 1800 | Off | 1800 |
| Location of Draw Point, cm Before Inlet to Expansion Zone | In High Pressure Zone | 36 | In High Pressure Zone | 61 |

TABLE 3

| | Product | Microwave Power (Watts) | Straight Properties Ten(gpd) | EB(%) | Knot Properties Ten(gpd) | EB(%) | Dimensions Width (mm) | Thickness (mm) | Width-to Thickness Ratio |
|---|---|---|---|---|---|---|---|---|---|
| Comparative 3 | 6000 Denier | Off | 9.40 | 18.5 | 5.3 | 17.5 | 1.38 | 0.46 | 3 |
| Example 4 | 6000 Denier | 1800 | 9.7 | 17.4 | 5.4 | 14.8 | 1.38 | 0.46 | 3 |
| Comparative 4 | 3000 Denier | Off | 9.26 | 16.7 | 6.3 | 12.8 | 0.99 | 0.33 | 3 |

TABLE 3-continued

| | Product | Microwave Power (Watts) | Straight Properties Ten(gpd) | EB(%) | Knot* Properties Ten(gpd) | EB(%) | Dimensions Width (mm) | Thickness (mm) | Width-to Thickness Ratio |
|---|---|---|---|---|---|---|---|---|---|
| Example 5 | 3000 Denier | 1800 | 9.95 | 17.8 | 6.3 | 12.5 | 0.99 | 0.33 | 3 |

We claim:

1. In a process including the steps of spinning, water-quenching, and drawing a heavy denier, polyamide monofilament in at least first and second draw stages, the quenched monofilament being advanced in the first draw stage through a steamer containing a high temperature steam atmosphere and being advanced in the second draw stage through a zone heated with a radiant heater, the total draw ratio being at least about 5.5×, the improvement which comprises:

advancing said monofilament through a draw point localization zone in said first draw stage in advance of and remote from said steamer;

providing a generally uniform coating of liquid water to said monofilament in said draw point localization zone, said water being provided in an amount greater than about 5% by weight based on the dry weight of the monofilament; and heating said coating of water on said monofilament in said draw point localization zone generally uniformly to a temperature greater than about 90° C. to induce neck draw of said monofilament in said draw point localization zone.

2. The process of claim 1 wherein at least about 80% of said drawing in said first draw stage occurs in said draw point localization zone.

3. The process of claim 1 wherein said amount of water provided on said monofilament is between about 5% and about 25% by weight based on the dry weight of the monofilament.

4. The process of claim 1 wherein said amount of water provided on said monofilament is between about 10% and about 15% by weight based on the dry weight of the monofilament.

5. The process of claim 1 wherein said coating of water is heated to greater than about 95° C.

6. The process of claim 1 wherein said coating of water is heated to greater than about 98° C.

7. The process of claim 1 wherein the quenched monofilament has a thickness greater than about 0.8 mm.

8. The process of claim 1 wherein said quenched filament has a core, said core having a temperature before said monofilament is advanced into said draw point localization zone of less than about 55° C.

9. The process of claim 1 wherein said quenched filament has a core, said core having a temperature before said monofilament is advanced into said draw point localization zone of less than about 50° C.

10. The process of claim 1 wherein said draw point localization zone is enclosed within a draw point localization chamber and said coating of water is provided by applying water to said monofilament in said chamber.

11. The process of claim 10 wherein said water applied in said chamber is heated to at least about 90° C. and said coating of water is further heated by contacting said coating of water with saturated steam in said chamber.

12. The process of claim 10 wherein said coating of water is heated by exposing said coating of water to microwave radiation in said chamber.

13. The process of claim 10 wherein said monofilament is advanced vertically downwardly through said chamber.

14. The process of claim 1 wherein said polyamide is poly(hexamethylene adipamide).

15. The process of claim 1 wherein the temperature of said high temperature steam atmosphere is greater than about 5° C. below the melting point of the hydrated polyamide of the monofilament.

16. The process of claim 1 wherein said monofilament is advanced into said draw point localization zone at a speed greater than about 75 meters per minute.

* * * * *